US006345934B1

(12) United States Patent
Jailloux et al.

(10) Patent No.: US 6,345,934 B1
(45) Date of Patent: Feb. 12, 2002

(54) EARTH STRUCTURE AND METHOD FOR CONSTRUCTING WITH SUPPORTS HAVING REARWARDLY LOCATED PORTIONS

(76) Inventors: Jean-Marc Jailloux, 20, avenue Mauvoisin, Sannois (FR), F-95110; Gianluigi Bregoli, Via Col di Lana 8, Bologna (IT), 40131

( * ) Notice: Subject to any disclaimer, the term of this patent is extended or adjusted under 35 U.S.C. 154(b) by 0 days.

(21) Appl. No.: 09/171,241

(22) PCT Filed: Apr. 15, 1997

(86) PCT No.: PCT/GB97/01053

§ 371 Date: Apr. 19, 1999

§ 102(e) Date: Apr. 19, 1999

(87) PCT Pub. No.: WO97/39196

PCT Pub. Date: Oct. 23, 1997

(30) Foreign Application Priority Data

Apr. 15, 1996 (GB) ..... 9607782

(51) Int. Cl.[7] ..... E02D 29/02
(52) U.S. Cl. ..... 405/262; 405/284; 405/285
(58) Field of Search ..... 405/262, 284, 405/285, 286, 287

(56) References Cited

U.S. PATENT DOCUMENTS

| | | | | | |
|---|---|---|---|---|---|
| 3,316,721 | A | * | 5/1967 | Heilig | 405/262 |
| 3,869,868 | A | * | 3/1975 | Irsai | 405/285 |
| 4,117,686 | A | * | 10/1978 | Hilfiker | 405/284 |
| 4,273,476 | A | * | 6/1981 | Kotulla et al. | 405/284 X |
| 4,329,089 | A | * | 5/1982 | Hilfiker et al. | 405/262 |
| 4,391,557 | A | * | 7/1983 | Hilfiker et al. | 405/287 |
| 4,505,621 | A | * | 3/1985 | Hilfiker et al. | 405/284 |
| 4,856,939 | A | * | 8/1989 | Hilfiker | 405/284 |
| 4,952,098 | A | * | 8/1990 | Grayson et al. | 405/262 |
| 4,961,673 | A | * | 10/1990 | Pagano et al. | 405/287 |
| 5,044,833 | A | * | 9/1991 | Wilfiker | 405/284 X |
| 5,156,496 | A | * | 10/1992 | Vidal et al. | 405/262 |
| 5,722,799 | A | * | 3/1998 | Hilfiker | 405/262 |
| 5,733,072 | A | * | 3/1998 | Hilfiker et al. | 405/262 X |
| 5,797,706 | A | * | 8/1998 | Segrestin et al. | 405/262 |

FOREIGN PATENT DOCUMENTS

| | | | | |
|---|---|---|---|---|
| CH | 680078 | * | 6/1992 | |
| DE | G8326632.1 | | 10/1985 | |
| EP | 0 197 000 B1 | | 3/1985 | |
| EP | 0 197 000 A1 | | 10/1986 | |
| EP | 0305258 | | 3/1989 | |
| EP | 0 318 243 A1 | | 5/1989 | |
| EP | 0574233 | | 12/1993 | |
| JP | 5287750 | * | 11/1993 | 405/258 |
| JP | 6081348 | * | 3/1994 | 405/258 |
| JP | 6146286 | * | 5/1994 | 405/32 |
| WO | 9500712 | | 1/1995 | |
| WO | 9506784 | | 3/1995 | |

* cited by examiner

*Primary Examiner*—David Bagnell
*Assistant Examiner*—Jong-Suk Lee
(74) *Attorney, Agent, or Firm*—Banner & Witcoff, Ltd.

(57) ABSTRACT

An earth structure comprises a plurality of facing panels, a stabilized earth mass behind the facing panels and a plurality of supports for supporting the facing panels. The supports have rearwardly located portions and rest on their rearwardly located portions to support the facing panels during construction.

10 Claims, 4 Drawing Sheets

EARTH STRUCTURE AND METHOD FOR CONSTRUCTING WITH SUPPORTS HAVING REARWARDLY LOCATED PORTIONS

BACKGROUND OF THE INVENTION

The invention relates to earth structures, certain components for use in earth structures and to methods of constructing earth structures.

It is known from EP-A-0 318 243 to provide an earth structure frictionally stabilised by a plurality of elongate stabilising elements in the form of strips extending rearwardly from a facing of the structure into an earth mass. The earth is stabilised throughout the mass by frictional engagement with the strips, thereby enabling the earth mass to behave as an elastic material with greatly improved resistance to failure. The facing of the known structure consists of a series of rows of "C" shaped mesh facing panels arranged one above another. The panels in each row are supported by laterally spaced support straps. These are also "C" shaped, each having an upright front portion in front of the panels and relatively short upper and lower rearwardly extending portions. These upper and lower portions are connected to an earth stabilising strip. Thus the forward end of each stabilising strip is located between a rearwardly extending upper portion at the top of a support strap in one row and a rearwardly extending lower portion at the bottom of a support strap in the row above. A bolt passes through the upper and lower rearwardly extending portions and the stabilising strip to form a secure connection. The support straps are thus only able to support the facing panels in the desired upright condition when they are themselves bolted to an earth stabilising strip.

WO 95/00712 discloses connectors which attach to facing panels at two separated points and which have a common rear portion for attachment to stabilising strips as described above. Once constructed, this system is a successful one. However, the construction process is not as straightforward as it might be, since the facing panels need to be initially supported by temporary stays.

There are disclosed in EP-A-0 197 000 and DE-U-8 326 632, approximately 'L' shaped facing panels which may be placed on the ground without extra support. They do however suffer from the disadvantage that they need to be bent specially to the required form. This is difficult and time consuming to carry out on site and if carried out away from the site the resulting cumbersome shape of the facing panels results in high transportation costs.

SUMMARY OF THE INVENTION

According to one aspect of the present invention there is provided an earth structure comprising a plurality of facing panels, a stabilised earth mass behind the facing panels and a plurality of supports for supporting the facing panels, said supports having rearwardly located portions and being able to rest on their rearwardly extending portions to support the facing panels during construction.

According to another aspect of the present invention there is provided a support for supporting a facing panel for stabilised earth, the support having a rearwardly located portion and being able to rest on the rearwardly located portion to support the facing panel during construction.

The advantage of using such supports to support the facing panels is that construction is much simplified. The supports can simply rest on their rearwardly located portions (i.e. portions of the supports which are located rearwardly of the facing panels) to support the facing panels, which is convenient and useful at the stage when the facing panels are positioned during construction.

According to another aspect of the present invention there is provided a method of constructing an earth structure, comprising providing a stabilised earth mass behind a facing panel, and providing a support for supporting the facing panel, the support having a rearwardly located portion, wherein the support and the facing panel are positioned with the support resting on its rearwardly located portion to support the facing panel.

In a preferred construction method, a second facing panel and a second support are positioned above the first-mentioned facing panel and support, and the first-mentioned facing panel is backfilled with earth before the rearwardly located portion of the second support is placed on said earth. This simplifies construction, in that backfilling of the first facing panel takes place before the second support is positioned, so that the second support need not obstruct the backfilling procedure.

The supports may be provided separately of earth stabilising means in the earth mass. The separately provided supports are preferably connected to the earth stabilising means, by a bolted or other connection.

According to a preferred embodiment the supports comprise connectors between the facing panels and separate earth stabilising means. Such connectors are preferably relatively small and light in comparison to the facing panels and are therefore easy to transport to a construction site, compared to the 'L' shaped facing panels of EP-A-0 197 000 and DE-U-8 326 632.

A connector may be attached to an earth stabilising means before being attached to a facing panel. Preferably, however, the connector and the facing panel are connected together first, and then they can be properly positioned before the earth stabilising means is attached.

The stabilising means to be attached to the connector may take various forms, such as those disclosed in WO 95/00712.

Rather than having connectors provided separately of the earth stabilising means, in an alternative form of the invention the supports may themselves comprise earth stabilising means. Thus the supports may comprise forward end portions of the earth stabilising means. Such an arrangement eliminates the need for a connection (e.g. a bolted connection) between a separate connector and an earth stabilising means, and is advantageous over systems having 'L' shaped panels since the earth stabilising means can be relatively narrow.

Preferably each support has at least two laterally spaced rearwardly located portions. By having laterally spaced rearwardly located portions, the support means can itself be relatively stable against lateral movement during construction, and can thus give improved support for the facing panel. The laterally spaced rearwardly located portions are preferably interconnected in a manner maintaining their relative lateral positions. Such interconnection can be achieved for example by a single member e.g. a bar which extends both rearwardly and laterally (being for example U- or V-shaped), or by a pair of rearwardly extending and laterally spaced members, e.g. a pair of bars which are interconnected by at least one cross-member e.g. a cross-bar.

Each support preferably has an upwardly extending portion extending up a respective facing panel. In order to minimise the size of the support, the upwardly extending portion preferably extends only partly up a facing panel which it supports, for example about half way up.

A support may have a single upwardly extending portion to provide the required support. Preferably however each support has at least two laterally spaced upwardly extending portions. This can impart greater stability to the facing panel whilst the earth structure is being constructed, particularly if it is a relatively flexible mesh panel. It also helps to distribute the load from the earth stabilisation during use.

In one preferred embodiment the upwardly extending portion is connected at an upper end thereof to a rearwardly located portion to form substantially an inverted 'V' shape. It is a preferred feature of this embodiment that the upwardly extending portion and rearwardly located portion are both engaged with earth stabilising means, to provide attachment thereto.

A preferred feature is that each upwardly extending portion extends from a respective rearwardly located portion. In the case of a connector, each such rearwardly located portion may be connected to a respective discrete earth stabilising means, for example an earth stabilising strip. In a preferred embodiment, however, the rearwardly located portions converge towards the rear of the connector. An earth stabilising means, such as a strip, may then be attached at the common rear point. In the case of the support itself comprising the earth stabilising means, an upwardly extending portion may extend from each edge of the earth stabilising means, for example a ladder shaped strip. Even if the edges of the earth stabilising means are substantially parallel, they could diverge towards the end providing the upwardly extending portions, to increase stability.

If the supports comprise forward end portions of earth stabilising means, the upwardly extending portion could have the same construction as the rest of the earth stabilising means, e.g. by bending one end of a flat earth stabilising member. This has the advantage that a continuous length of earth stabilising material can be made, cut into appropriate lengths and the upwardly extending portions formed. An example of this is a ladder shaped strip having cross-bars both along its earth stabilising length and on its upwardly extending portion. An alternative construction, however, could have the cross-bars omitted from the upwardly extending portion, which may assist connection to a facing panel.

In a particularly preferred embodiment the earth stabilising means comprises a ladder strip having one end bent to form an upwardly extending portion which engages with a mesh facing panel. The width of the ladder strip is chosen to be less than the vertical spacing of the facing panel mesh to allow the upwardly extending portion to pass through the facing panel and to interlock therewith. By arranging the horizontal bars of the upwardly extending portion to be just above those of the mesh facing panel, extra protection against relative slippage between them is achieved.

The ability of the support of the invention to support a facing panel may be advantageous when using sheet metal or concrete facing panels. However, it is usually possible for such panels to be supported during construction by previously installed panels, obviating the need in most cases for a support with a rearwardly located portion. The advantages of the present invention arise particularly when the facing panels are mesh facing panels. These have the advantage of being light in weight and relatively inexpensive.

An upwardly extending portion of a support may be attached to a facing panel by any suitable means, for example by wire ties or the like. Preferably, the upwardly extending portion interlocks with a facing panel by passing through the plane of the panel in opposite directions at two or more vertically separated points. For example, an upwardly extending portion may pass through a panel from behind, extend vertically along the front of the panel some way, pass back through the panel to the rear, and then extend vertically along the rear of the panel some way. This arrangement ensures that no significant rearward rotational movement of the facing panel about the upward portion of the connector is possible, thereby supporting the facing panel during construction. If the facing panel slopes to the rear, for example, then the support member need only be able to restrain rearward rotation when the panel is being initially positioned. Additional restraint, against forward rotation, may be achieved by using wire ties or the like, or by passing the upwardly extending portion through the plane of the facing more than twice.

If mesh facing panels are used, the upwardly extending portion may simply pass through the openings in the mesh, i.e. between the grid wires.

To resist forward movement against pressure from the earth mass during backfilling of the facing panels, there are preferably provided anchor members connected between the facing panels and the support members. In the embodiment described above in which the upwardly extending portion is connected to the rearwardly located portion at an upper end thereof, such an anchor member could be comprised by the rearwardly located portion. Since the facing panels are supported by the support members during construction, they are preferably flat to facilitate transport and storage and also to obviate the need to bend mesh panels if these are used. This reduces expense.

A support may serve to interconnect vertically adjacent facing panels, for example, in the case of mesh facing panels, by being attached to two horizontal bars of vertically adjacent panels. Preferably, a support is attached to a lower portion of a facing panel and the facing panel lower portion is disposed forwardly of an upper portion of a facing panel below. Earth pressure developed at this upper portion is then transmitted, at least partly, to the lower portion of the panel above and then to the support. It is thus not necessary for the support to be attached directly to the lower panel, with the advantage that during earth settlement the upper panel and support can move downwardly by a large distance relative to the lower panel without causing it to bulge.

BRIEF DESCRIPTION OF THE DRAWING

Certain preferred embodiments of the invention will now be described by way of example and with reference to the accompanying drawings, in which.

DESCRIPTION OF THE PREFERRED EMBODIMENTS

Figure 1:
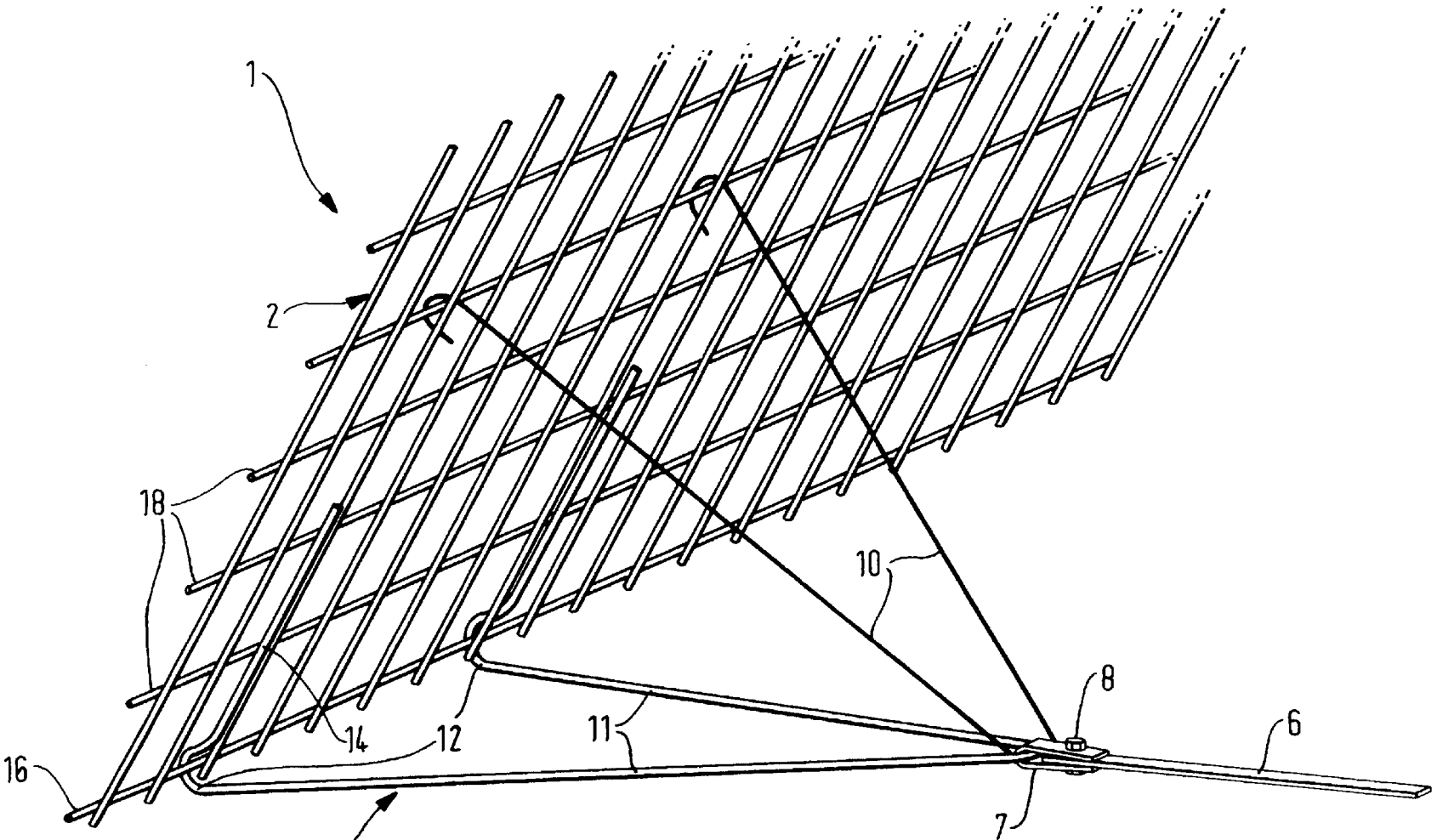
FIG. 1 is a rear perspective view of a mesh facing panel for an earth structure being supported by a connector during construction, according to a first embodiment.

Referring to FIG. 1, an earth structure during construction is indicated generally by the reference numeral 1. A steel mesh facing panel 2 is made from e.g. 8 mm diameter wire spaced at e.g. 150 mm intervals in horizontal and vertical directions. The panel typically has dimensions of 6 m×0.9 m. The panel is supported at an inclination of 2:1 (vertical:horizontal) by a support in the form of a connector 4, made from a steel bar of e.g. 10 mm or 12 mm diameter. Other inclinations including vertical are possible. Earth stabilising means in the form of a steel strip 6 is attached to the back of the connector by a lug 7 and a bolt 8. To provide resistance against forward movement when the facing panel is backfilled, anchor members in the form of anchorage hooks 10 are attached between a top portion of the facing panel 2 and the connector 4. As can be seen from the Figure, the connector has two rearwardly located portions in the form of convergent leg portions 11 which act as a base on which the connector can rest. At the end of each leg portion is a bend 12 which joins it to a respective upwardly extending portion 14. The bends pass under the lowermost horizontal wire 16 of the mesh panel and then are sufficiently curved to pass back through the mesh opening above this wire. The upward portions 14 are straight and pass along the rear of the panel abutting against the first few horizontal wires 18. The weight of the panel is thus transmitted to the upward portions 14 of the connectors 4 and is supported by the resilience of the bends 12. One or more connectors 4 may be provided for the facing panel.

Figure 2:
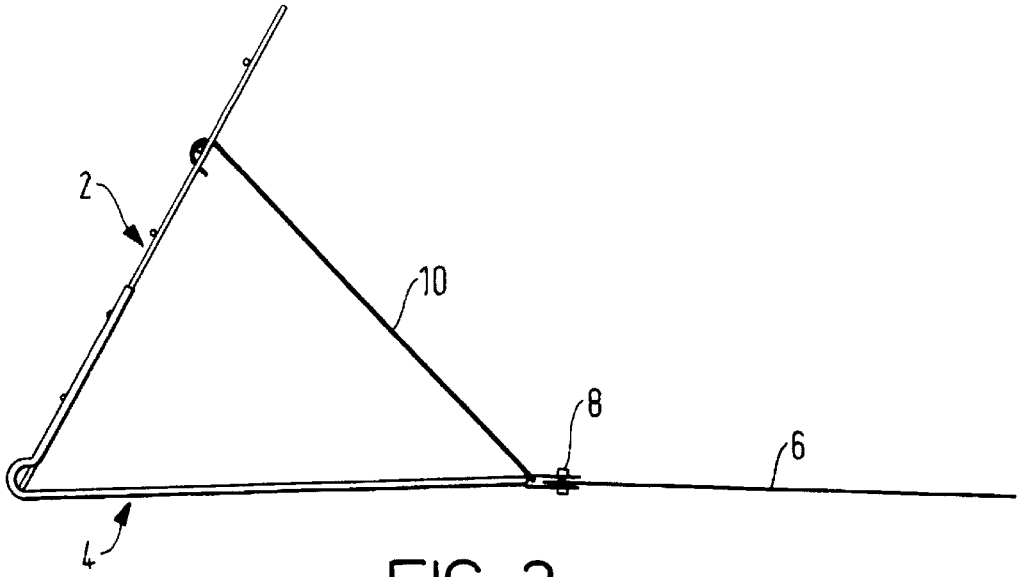
FIG. 2 is a side elevation of an earth structure before commencement of backfilling.

The structure before backfilling may be seen in side elevation from FIG. 2.

The process of constructing the earth structure will now be described. One or more connectors are placed on the ground. A flat mesh facing panel is then placed over the upward portions 14 of the connectors 4 so that they extend through the holes in the mesh formed above the lowermost horizontal wires 16 of the panel. The panel 2 is then rotated about wire 16 towards the connectors 4 until it rests on portions 14. Wire ties may additionally be used if desired. The panel and connector may now be safely left while the strip 6 and anchorage hook 10 are attached, a lining (not shown; for example a coconut fibre mat plus a plastics grid) is placed behind the facing panel to contain earth particles, and backfilling is commenced. Earth is filled and compacted from the rear of the structure out to the facing panel, thus covering the reinforcing strip 6 first. Once the level of the compacted earth has reached the top of the facing panel 2, another connector 4 is placed on top of the layer of earth. The bottom horizontal wire 16 of the upper panel is initially spaced upwardly from the top horizontal wire 16 of the panel below by a block of wood 20. The bottom horizontal wire 16 is positioned in front of the vertical wires of the upper portion of the panel below. Once the structure is complete the wood block 20 can be removed to allow the upper panel to move downwardly relative to the one below as the structure settles, without compressing the panel below and causing it to bulge in an unsightly manner. The wood block may for example allow up to 80 mm of settlement.

Figure 3:
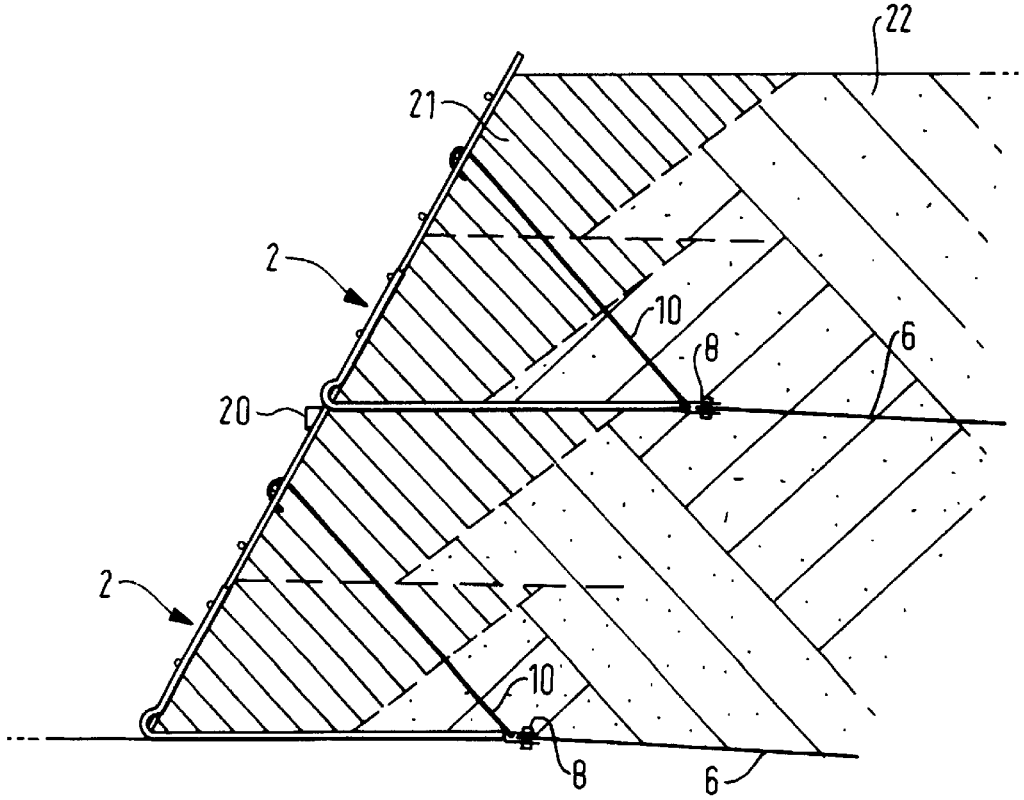
FIG. 3 is a side elevation of a two-layer earth structure

The above process is repeated until the earth structure has attained the desired height as seen from FIG. 3. The structure may of course be as many panels wide as required. In use, tension from the earth reinforcing strips 6 is transmitted to the facing panels through the leg portions 11. Earth pressure developed at the upper portion of a facing panel is partly transmitted to the bottom horizontal wire 16 of the panel above, then to the connectors 4 and the strips 6.

It will be noted that the earth is divided into a top soil portion 21 immediately behind the facing and a structural backfill portion 22 to the rear. Following completion of the facing, vegetation is installed by hydroseeding.

It will be seen that in the embodiment described above the facing panel and the connector together define a self-supporting unit. The connector extends a sufficient distance rearwardly to prevent the facing panel from toppling rearwardly, without having to be attached to the earth stabilising means, although such attachment can optionally be carried out before the facing panel is connected to the connector.

Figure 4:
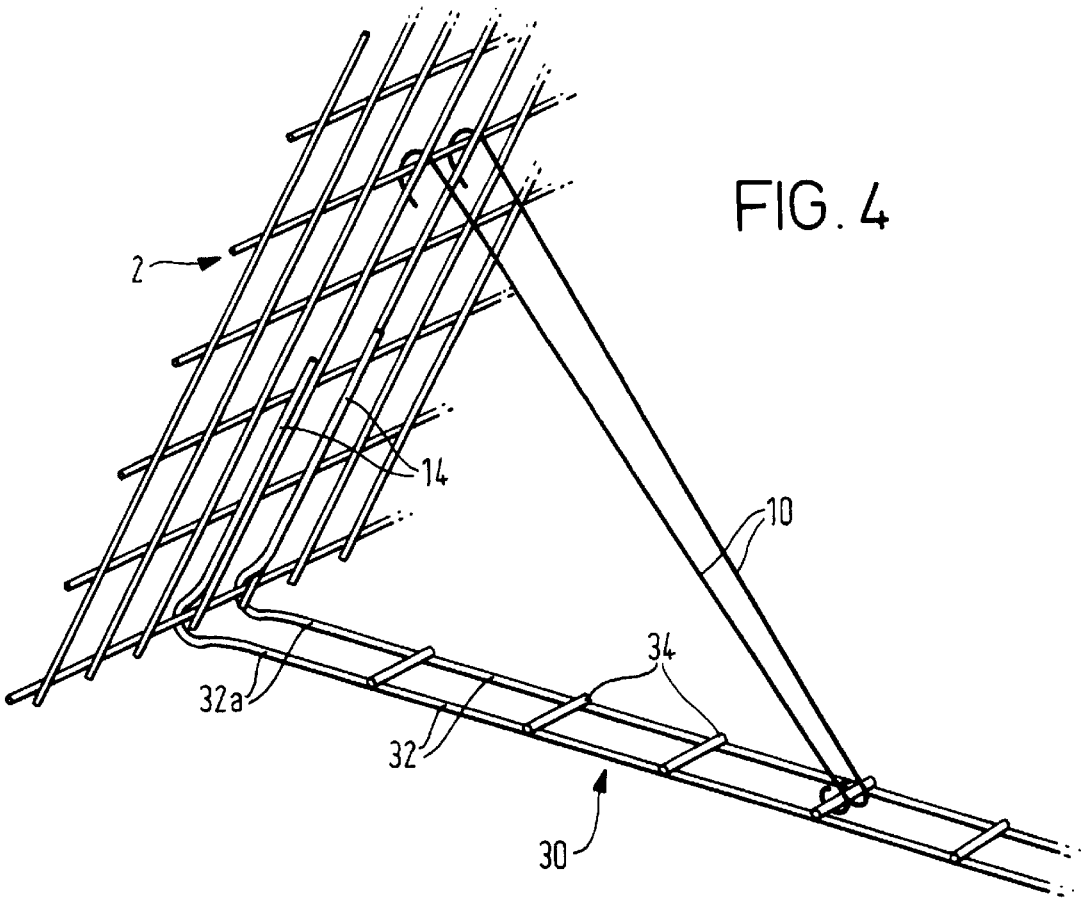
FIG. 4 is a rear perspective view of a mesh facing panel for an earth structure being supported by an earth stabilising means during construction according to a second embodiment.

A second embodiment is shown in FIG. 4, in which the support takes the form of an earth stabilising member 30. As can be seen, there is no separate connector in this embodiment. The earth stabilising member comprises two laterally spaced substantially parallel longitudinal bars 32 at its side edges, the bars extending rearwardly into the earth mass. The bars 32 form rearwardly located portions to support the facing panel during construction. The bars 32 are connected by a plurality of transverse cross bars 34. Forwardly of the front cross bar 34, each longitudinal bar 32 is bent to form an upwardly extending portion 14 which engages with a facing panel 2 as described above in relation to the first embodiment. The two upwardly extending portions 14 are shown extending from substantially parallel end portions 32*a* of the bars 32. These end portions may, however, diverge to provide a wider base area on which to support the facing panel 2. This gives an improved load distribution, both whilst supporting the panel during construction, and in use in transferring load from the earth stabilising member. The process of backfilling the structure described above may be used without modification except that the earth stabilising members 30 are attached directly to the facing panels 2, there being no connectors 4.

Figure 5:
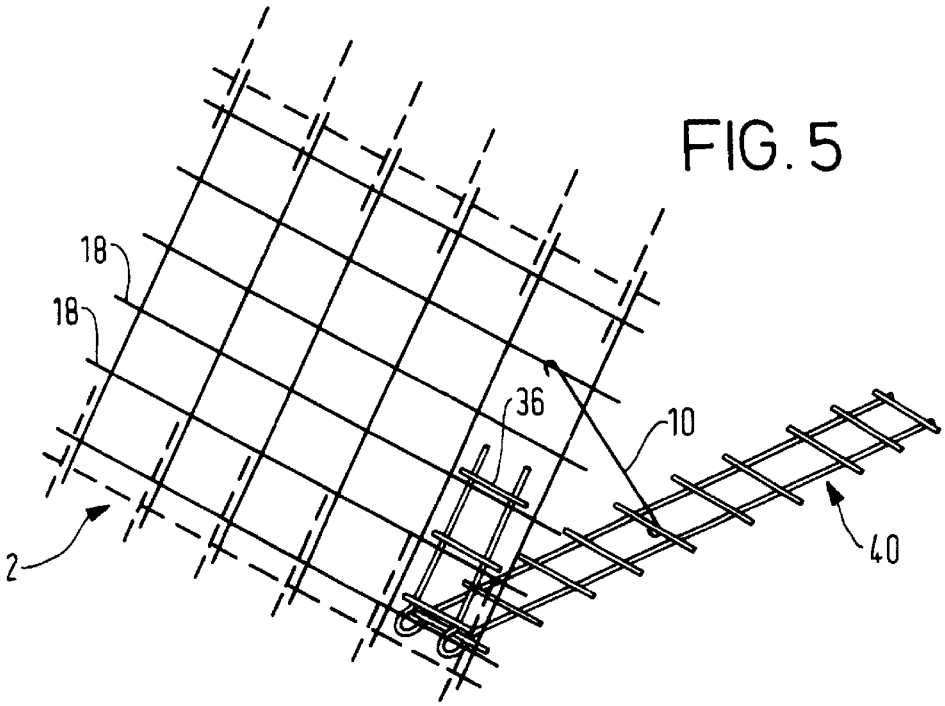
FIGS. 5 and 6 are perspective and side views respectively of a third embodiment of the invention.
Figure 6:
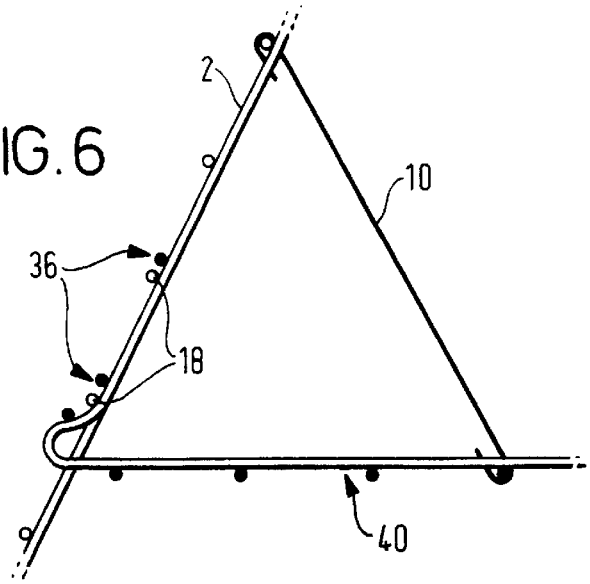

FIGS. 5 and 6 show a third embodiment of the invention. This embodiment is similar to the second embodiment described above and therefore corresponding reference numerals are used where appropriate. One of the two main differences over the embodiment set out above is that a number of cross-members 36 are provided on the upwardly extending portions 14. As can be seen particularly from FIG. 6, the cross-members 36 of the earth stabilising member 40 are so arranged that they are in the same plane as the horizontal wires 18 of the facing panel. By this arrangement, relative slippage between the facing panel and earth stabilising member can be prevented since this will cause the two sets of wires 18,36 to interlock.

The second main difference is that the width of the member 40 is less than the spacing between adjacent vertical wires 38 of the facing panel 2. This is necessary to allow the upwardly extending part of the earth stabilising member to pass through the mesh panel. This embodiment demonstrates that one anchorage hook 10 may be sufficient.

Figure 7:
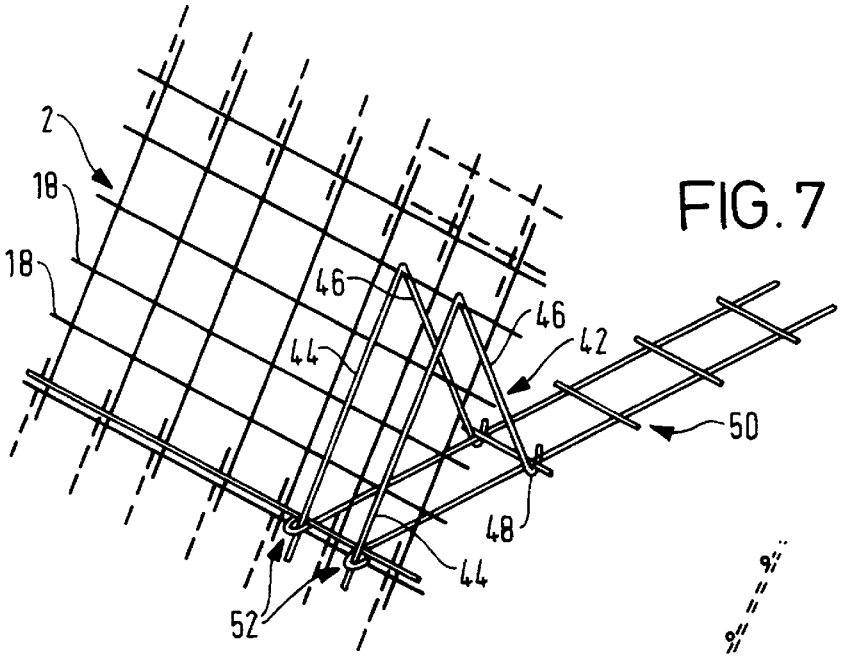
FIGS. 7 and 8 are perspective and side views respectively of a fourth embodiment.
Figure 8:
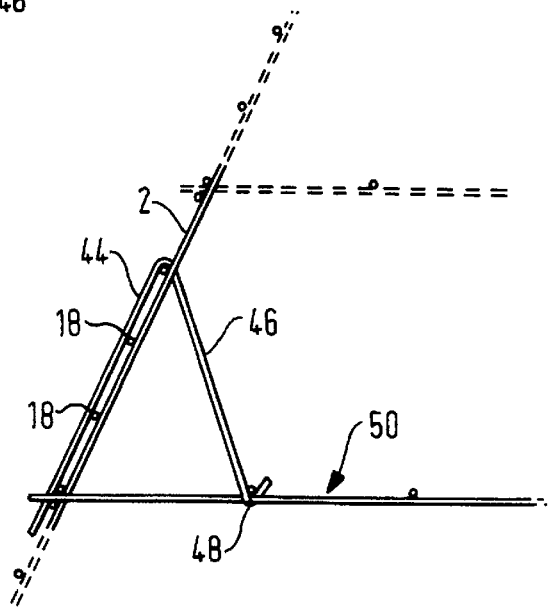

FIGS. 7 and 8 show a fourth embodiment of the invention. In this embodiment the support consists of a pair of laterally spaced support members 42, which are substantially in the shape of an inverted 'V'. Each support member 42 comprises an upwardly extending support portion 44 and a rearwardly located portion 46. A hook 48 is formed at the end of the rearwardly located portion 46 to engage with the cross-member 34 of a ladder type earth stabilising member 50 in a manner analogous to the anchorage members 10, above. This ladder member has loop eyes 52 formed at forward ends of its longitudinal bars 32. The upwardly extending portion 44 of two support members 42 pass through respective eyes 52, in front of the facing panel to provide mechanical engagement between the facing panel 2 and earth stabilising member 50.

In FIG. 7, two bar-like support members 42 are shown, being used with one earth stabilising strip 50, one for each side. Of course other arrangements might also be used—for example the two members 52 could be connected laterally, at their top say, to form a single, more stable support member.

Although certain preferred embodiments have been described above, it is to be understood that various modifications may be made without departing from the scope off the invention. For example, the facing panels can be solid metal or concrete with suitable holes for the support member to pass through.

What is claimed is:

1. An earth structure comprising a plurality of facing panels, said facing panels extending upwardly, a stabilized earth mass behind the facing panels and a plurality of supports for supporting the facing panels, said supports having first and second laterally spaced, upwardly extending portions positioned against the facing panels, said upwardly extending portions being shorter than the facing panels and extending part way up the facing panels, and rearwardly located portions horizontally extending from said upwardly extending portions for support of the facing panels during construction, said rearwardly located portions converging together and permanently connected to define a base for support of the spaced, upwardly extending portions during construction of the earth structure.

2. The earth structure as claimed in claim 1 wherein said upwardly extending portions interlock with said facing panel by passing through the plane of the panel in opposite directions at two or more vertically separated points.

3. The earth structure as claimed in claim 1 wherein said supports are provided separately of earth stabilizing means in the earth mass and are connected thereto.

4. The earth structure as claimed in claim 1 wherein said supports comprise forward end portions of earth stabilizing means in the earth mass.

5. The earth structure as claimed in claim 1 comprising anchor members connected between the facing panels and the supports, for providing resistance to forward movement of the facing panels.

6. The earth structure as claimed in claim 1 wherein said support is attached to a lower portion of said facing panel, the lower portion of the facing panel being disposed forwardly to an upper portion of an adjacent facing panel located below said facing panel.

7. A method of constructing an earth structure, comprising, in combination, the steps of (a) providing a facing panel;

(b) providing a support comprising an upward extent having at least two laterally spaced portions extending upwardly and against the facing panel, said upward extent being shorter than the facing panel upward extent for supporting the facing panel and rearwardly located portions horizontally extending from the spaced portions of the upward extent, and converging together and permanently connected to define a base, wherein the support and the facing panel are positioned with the support resting on said base to support the facing panel; and (c) providing a stabilized earth mass behind said facing panel.

8. The method as claimed in claim 7, wherein said support comprises connectors between the facing panels and earth stabilizing means in the earth mass.

9. The method as claimed in claim 7, wherein said support comprises a forward end portion of an earth stabilizing means in the earth mass.

10. The method as claimed in claim 7, 8 or 9, wherein a second facing panel and a second support are positioned above the first-mentioned facing panel and support, and wherein the first-mentioned facing panel is backfilled with earth before the rearwardly located portion of the second support is placed on said earth.

* * * * *